US006064363A

United States Patent [19]

Kwon

[11] Patent Number: 6,064,363

[45] Date of Patent: May 16, 2000

[54] DRIVING CIRCUIT AND METHOD THEREOF FOR A DISPLAY DEVICE

[75] Inventor: Oh-Kyong Kwon, Seoul, Rep. of Korea

[73] Assignee: LG Semicon Co., Ltd., Cheongju, Rep. of Korea

[21] Appl. No.: 09/039,481

[22] Filed: Mar. 16, 1998

[30] Foreign Application Priority Data

Apr. 7, 1997 [KR] Rep. of Korea ..... 97-12729

[51] Int. Cl.[7] ..... G09G 3/36

[52] U.S. Cl. ..... 345/98; 345/94; 345/100

[58] Field of Search ..... 345/87, 90, 92, 345/94–96, 98, 100, 204, 208, 209

[56] References Cited

U.S. PATENT DOCUMENTS 5,465,054 11/1995 Erhart ..... 326/34
5,510,748 4/1996 Erhart ..... 327/530
5,528,256 6/1996 Erhart ..... 345/96
5,572,211 11/1996 Erhart ..... 341/144
5,578,957 11/1996 Erhart ..... 327/333
5,604,449 2/1997 Erhart ..... 326/81

FOREIGN PATENT DOCUMENTS 0 488 516 6/1992 European Pat. Off. .
2188473 9/1987 United Kingdom .

*Primary Examiner*—Regina Liang
*Attorney, Agent, or Firm*—Fleshner & Kim, LLP

[57] ABSTRACT

A driving circuit for an electric charge recycling TFT-LCD and a method thereof which are capable of preventing a characteristic deterioration of an LCD and TFT by reducing a power consumption of a dot inversion and column inversion methods. The circuit includes a connector unit, e.g., a recycling unit, having a plurality of transmission gates and/or pass transistors connected between the data driving unit and the LCD panel, that recycles electric charges charged in the data line DL in accordance with an electric charge recycling control signal CR during a blank time.

22 Claims, 9 Drawing Sheets

FIG. 3A
CONVENTIONAL ART

| | ODD FRAMES | | | | EVEN FRAMES | | | |
|---|---|---|---|---|---|---|---|---|
| | DL#1 | DL#2 | DL#3 | DL#4 | DL#1 | DL#2 | DL#3 | DL#4 |
| GL#1 | + | + | + | + | — | — | — | — |
| GL#2 | + | + | + | + | — | — | — | — |
| GL#3 | + | + | + | + | — | — | — | — |
| GL#4 | + | + | + | + | — | — | — | — |

FIG. 3B
CONVENTIONAL ART

| | ODD FRAMES | | | | EVEN FRAMES | | | |
|---|---|---|---|---|---|---|---|---|
| | DL#1 | DL#2 | DL#3 | DL#4 | DL#1 | DL#2 | DL#3 | DL#4 |
| GL#1 | + | + | + | + | — | — | — | — |
| GL#2 | — | — | — | — | + | + | + | + |
| GL#3 | + | + | + | + | — | — | — | — |
| GL#4 | — | — | — | — | + | + | + | + |

+ : POSITIVE VIDEO SIGNAL  — : NEGATIVE VIDEO SIGNAL

FIG. 3C
CONVENTIONAL ART

| | ODD FRAMES | | | | EVEN FRAMES | | | |
|---|---|---|---|---|---|---|---|---|
| | DL#1 | DL#2 | DL#3 | DL#4 | DL#1 | DL#2 | DL#3 | DL#4 |
| GL#1 | + | \| | + | \| | \| | + | \| | + |
| GL#2 | + | \| | + | \| | \| | + | \| | + |
| GL#3 | + | \| | + | \| | \| | + | \| | + |
| GL#4 | + | \| | + | \| | \| | + | \| | + |

FIG. 3D
CONVENTIONAL ART

| | ODD FRAMES | | | | EVEN FRAMES | | | |
|---|---|---|---|---|---|---|---|---|
| | DL#1 | DL#2 | DL#3 | DL#4 | DL#1 | DL#2 | DL#3 | DL#4 |
| GL#1 | + | — | + | — | — | + | — | + |
| GL#2 | — | + | — | + | + | — | + | — |
| GL#3 | + | — | + | — | — | + | — | + |
| GL#4 | — | + | — | + | + | — | + | — |

+ : POSITIVE VIDEO SIGNAL  — : NEGATIVE VIDEO SIGNAL

DRIVING CIRCUIT AND METHOD THEREOF FOR A DISPLAY DEVICE

BACKGROUND OF THE INVENTION

1. Field of the Invention

The present invention relates to a display device, and in particular, a driving circuit for an electric charge recycling Thin Film Transistor-Liquid Crystal Display (TFT-LCD) and a method thereof.

2. Background of the Related Art

As shown in FIG. 1, the conventional TFT-LCD driving circuit includes an LCD panel 10 having a plurality of pixels at the intersections of a plurality of gate lines GL and a plurality of data lines DL. A data driving unit 20 provides pixels with a signal, such as a video signal, through the data lines DL of the LCD panel 10, and a gate driving unit 30 selects a corresponding gate line GL of the LCD panel 10 and turns on a corresponding pixel.

The pixels are configured by a plurality of thin film transistors 1, each gate is connected with a corresponding gate line GL and each drain is connected with a corresponding a data line DL. A storing capacitor Cs and an LCD capacitor Clc are connected in parallel with the source of the thin film transistor 1.

A shift register (not shown) of the data driving unit 20 sequentially provides video data by one pixel, and a video data corresponding to the data line DL is stored. The gate driving unit 30 outputs a gate line selection signal GLS and selects a corresponding gate line GL from a plurality of gate lines GLn. The thin film transistors connected with the selected gate line GL are turned on, and the video data stored in the shift register (not shown) of the data driving unit 20 is applied to the drain, so that the video data are displayed on the LCD panel 10. When the above-described operations are repeatedly performed, the video data are displayed on the LCD panel 10.

At this time, the data driving unit 20 provides a VCOM, a positive video signal and a negative video signal to the LCD panel 10, so that the video data are displayed on the LCD panel 10. As shown in FIG. 2, in the conventional art, when the TFT-LCD driving circuit is driven, the positive video signal and the negative video signal are alternatively applied to the pixels whenever the frames are changed so that the LCD does not receive a DC voltage. Therefore, VCOM, which is an intermediate or a median voltage level between the positive video signal and the negative video signal, is applied to the electrode of the TFT-LCD upper plate.

When alternatively applying the positive video signal and the negative video signal to the LCD with respect to VCOM, a light transfer curve of the LCD is not identical, thus causing a flicker problem. In order to prevent the flicker problem, as shown in FIG. 3, the frame inversion method, the line inversion method, the column inversion method and the dot/pixel inversion method are used.

Namely, FIG. 3A illustrates the frame inversion method in which the polarity of a video signal is changed whenever the frame is changed, and FIG. 3B illustrates the line inversion method in which the polarity of a video signal is changed only whenever the gate line GL is changed. In addition, FIG. 3C illustrates the column inversion method in which the polarity of a video signal is changed whenever the data line DL and the frame are changed. FIG. 3D illustrates the dot inversion method in which the polarity of a video signal is changed whenever the gate line GL, data line DL and frame are changed.

At this time, the quality of the picture is increased using the frame inversion, the line inversion, the column inversion and the dot inversion, which is listed in order from lowest to highest quality. The number of the polarity changes is increased proportionally to the quality of the picture, thus increasing the power consumption. Such power consumption increase is undesirable.

For example, FIG. 4 illustrates a waveform of the odd number of the data lines DL and the even number of the data lines DL inputted into the LCD panel 10 in the dot inversion method. Namely, the polarity of the video signal of the data line DL is changed with respect to VCOM whenever the gate line GL is changed.

At this time, assuming that the entire portion of the TFT-LCD panel is gray color, the video signal variation width V of the data line DL becomes two times the VCOM and the variation width of the positive video signal or the VCOM and the variation width of the negative video signal. In addition, assuming that the capacitance of the data line DL is $C_L$, the power consumption of the output terminal is computed by the following equation.

$$P=V_{DD}\cdot I_{ave}=V_{DD}(C_L\cdot V\cdot F_{reqGL})$$

Where, a $V_{DD}$ is the power supply voltage, and a $F_{reqGL}$ is a gate line frequency.

Since the video signal is changed from positive to negative or from negative to positive whenever the gate line GL is changed, the power consumption is increased in the dot inversion method. Therefore, when fabricating the LCD device using a polycrystal silicon thin film transistor (Poly-si TFT), a large amount of heat is generated due to a high power consumption, so that there is a characteristic degradation of the LCD device.

SUMMARY OF THE INVENTION

Accordingly, it is an object of the present invention to overcome the aforementioned problems encountered in the conventional art.

It is another object of the present invention to prevent a characteristic deterioration of an LCD and TFT in inversion methods.

It is a further object of the present invention to reduce power consumption in dot and column inversion methods.

To achieve the above objects, there is provided a driving circuit for an electric charge recycling TFT-LCD according to a first embodiment of the present invention which includes a transmission gate unit or a pass transistor unit connected between the data driving unit and the LCD panel for recycling an electric charge charged in the capacitance $C_L$ of the data line DL in accordance with an electric charge recycling control signal CR during a blank time.

To achieve the above objects, there is provided a driving circuit for an electric charge recycling TFT-LCD according to a second embodiment of the present invention which includes an odd number of data lines DL and an even number of data lines DL which are short-circuited by an electric charge recycling control signal CR during a horizontal blank time or a vertical blank time.

The present invention may be achieved in a whole or in parts by a display device comprising a first driving circuit coupled to first signal lines; a second driving circuit coupled to second signal lines; a display unit having a plurality of pixels, each pixel coupled to a corresponding first signal line and a corresponding second signal line; and a connector unit coupled to the first driving circuit and the first signal lines, the connector unit connecting corresponding first signal lines to each other for a prescribed period of time.

The present invention can be also achieved in a whole or in parts by a recycling unit for a display device having a plurality of pixels coupled to a plurality of first and second signal lines, comprising at least one of a plurality of transmission gates and a plurality of pass transistors, each of the at least one of the plurality of transmission gates and the plurality of pass transistors being connected to corresponding signal lines having opposite signal polarity compared to a median potential level and being responsive to a control signal to short circuit the corresponding signal lines for a prescribed period of time in between application of signals of opposite polarity.

Additional advantages, objects, and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

The invention will be described in detail with reference to the following drawings in which like reference numerals refer to like elements wherein:

FIGS. 3A through 3D are views illustrating inversion methods of a TFT-LCD;

DETAILED DESCRIPTION OF PREFERRED EMBODIMENTS

Figure 1:
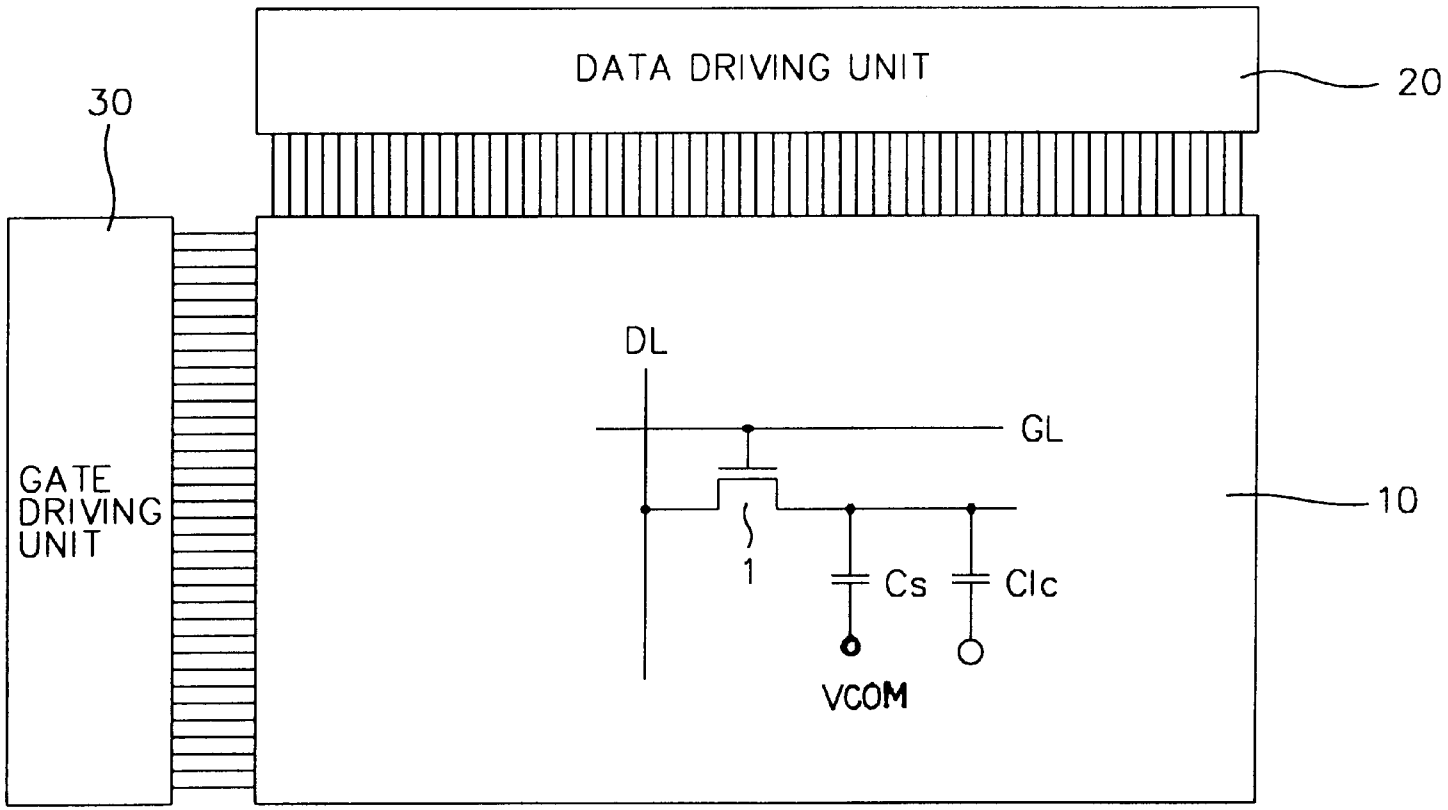
FIG. 1 CONVENTIONAL ART
FIG. 1 is a block diagram illustrating a conventional TFT-LCD driving circuit.
Figure 2:
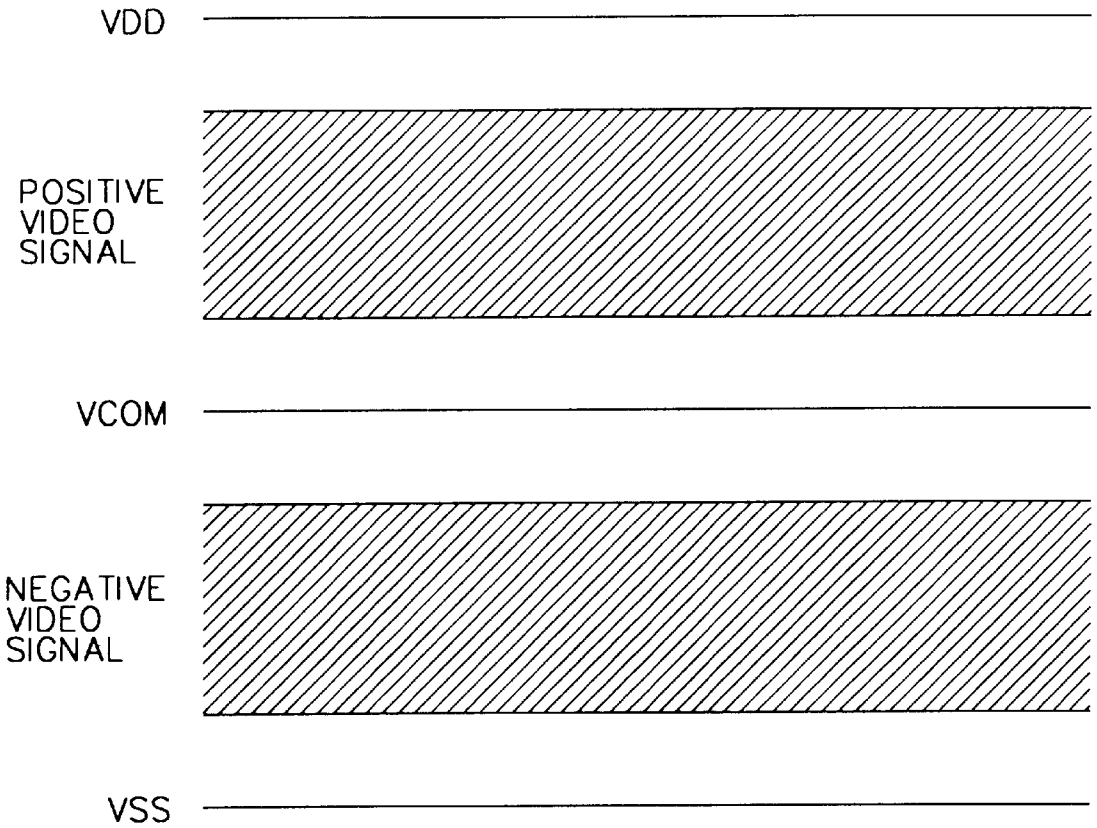
FIG. 2 CONVENTIONAL ART
FIG. 2 is a video signal polarity diagram illustrating a driving signal of a TFT-LCD of FIG. 1.
Figure 4:
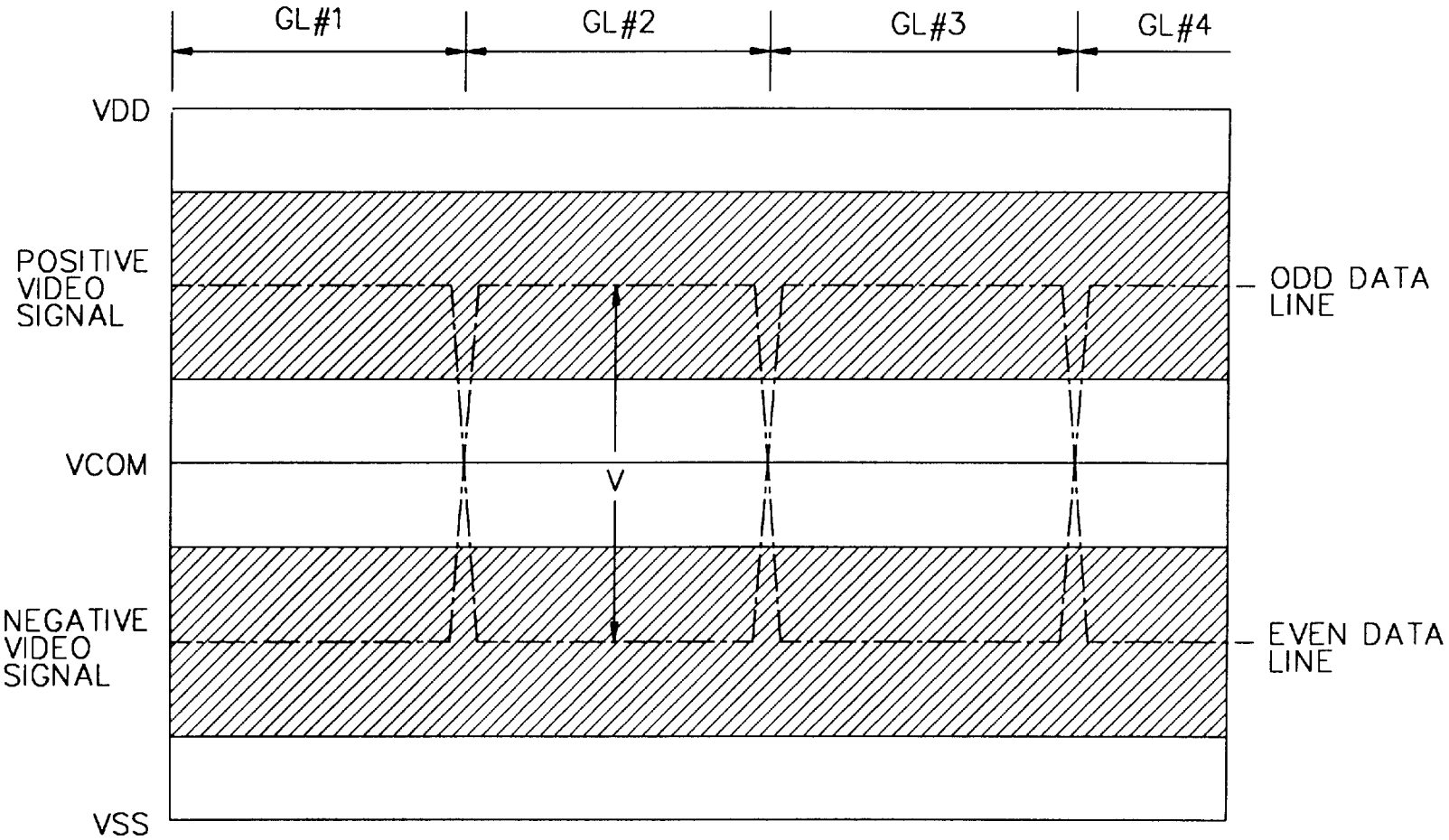
FIG. 4 CONVENTIONAL ART
FIG. 4 is a waveform diagram of a conventional dot inversion method.
Figure 5:
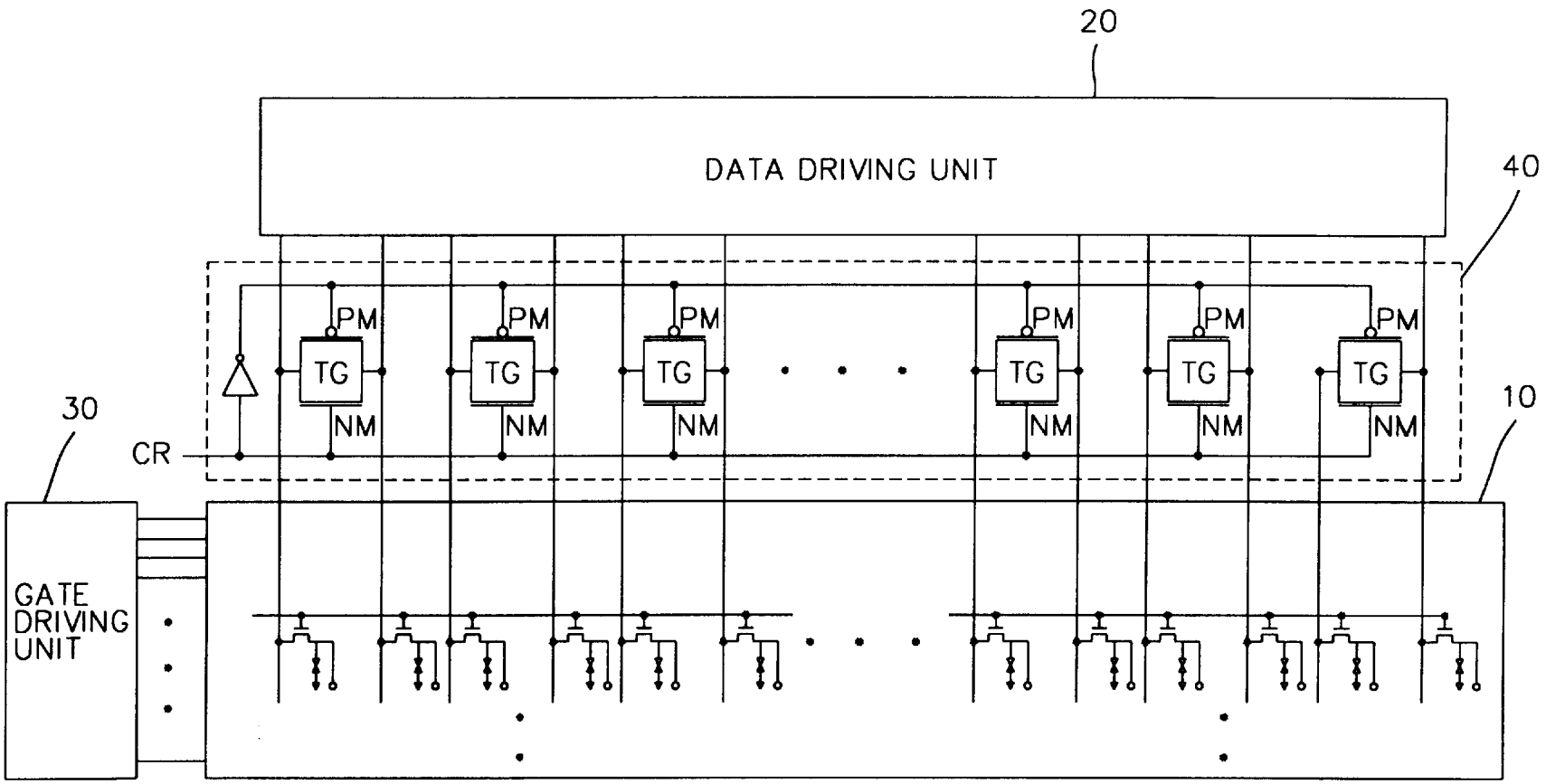
FIG. 5 is a block diagram illustrating an electric charge recycling TFT-LCD driving circuit according to the present invention.

As shown in FIG. 5, the electric charge recycling TFT-LCD circuit according to one of the preferred embodiments includes a connector unit 40 to recycle or reuse the electric charge stored in a capacitance $C_L$ of a data line DL, preferably referred to as a recycling unit. A detailed description of other components are omitted since they are preferably similar to FIG. 1.

The recycling unit 40 preferably includes a plurality of transmission gates TG connected between the odd number of the data lines DL and the even number of the data lines DL. Each transmission gate short circuits the odd number of data lines DL and the even number of data lines DL in accordance with a control signal, referred to as an electric charge recycling control signal CR. Each transmission gate TG is configured by connecting in parallel the PMOS transistor PM and the NMOS transistor NM and is controlled by a non-inverted or inverted electric charge recycling control signal CR.

As an example, a preferred operation of the driving circuit for an electric charge TFT-LCD is explained. First, the data driving unit 20 sequentially receives video data by one pixel and outputs video signals corresponding to a plurality of data lines DL, and the gate driving unit 30 outputs a gate line selection signal GLS and sequentially selects a plurality of gate lines GL one by one.

The thin film transistor connected with the selected gate line GL is turned on, and the negative and positive video signals from the data driving unit 20 are displayed on the LCD panel 10 through the odd number of the data lines DL and the even number of the data lines DL.

There exists a blank time between the frames and the gate lines GL in which the video signal is not inputted. The blank time between the gate lines GL is called a horizontal blank time, and the blank time between the frames is called a vertical blank time. Generally, the horizontal blank time is about 5.72 $\mu$s, and the vertical blank time is about 10 $\mu$s. The electric charge recycling control signal CR is turned on during the horizontal blank time of each gate line GL in the analog driving method. In the digital driving method, since the electric charge recycling control signal CR is used together with the line pulse signal after the gate line GL is turned on before the digital/analog conversion. The electric charge recycling control signal CR can be used for the analog and digital driving methods.

In the preferred invention, the electric charge recycling control signal CR having a predetermined pulse width is applied to the transmission gates TG of the recycling unit 40 during a predetermined time of the blank time, and then the transmission gates TG are turned on. When the transmission gates TG short-circuit the odd number of the data lines DL and the even number of the data lines DL in response to the electric charge recycling control signal CR, a portion of the electric charges on the data line DL, which is charged in the positive video signal state, is moved to the data line, which is charged in the negative video signal state, to recycle the electric charges between the short-circuited data lines DL.

Figure 6:
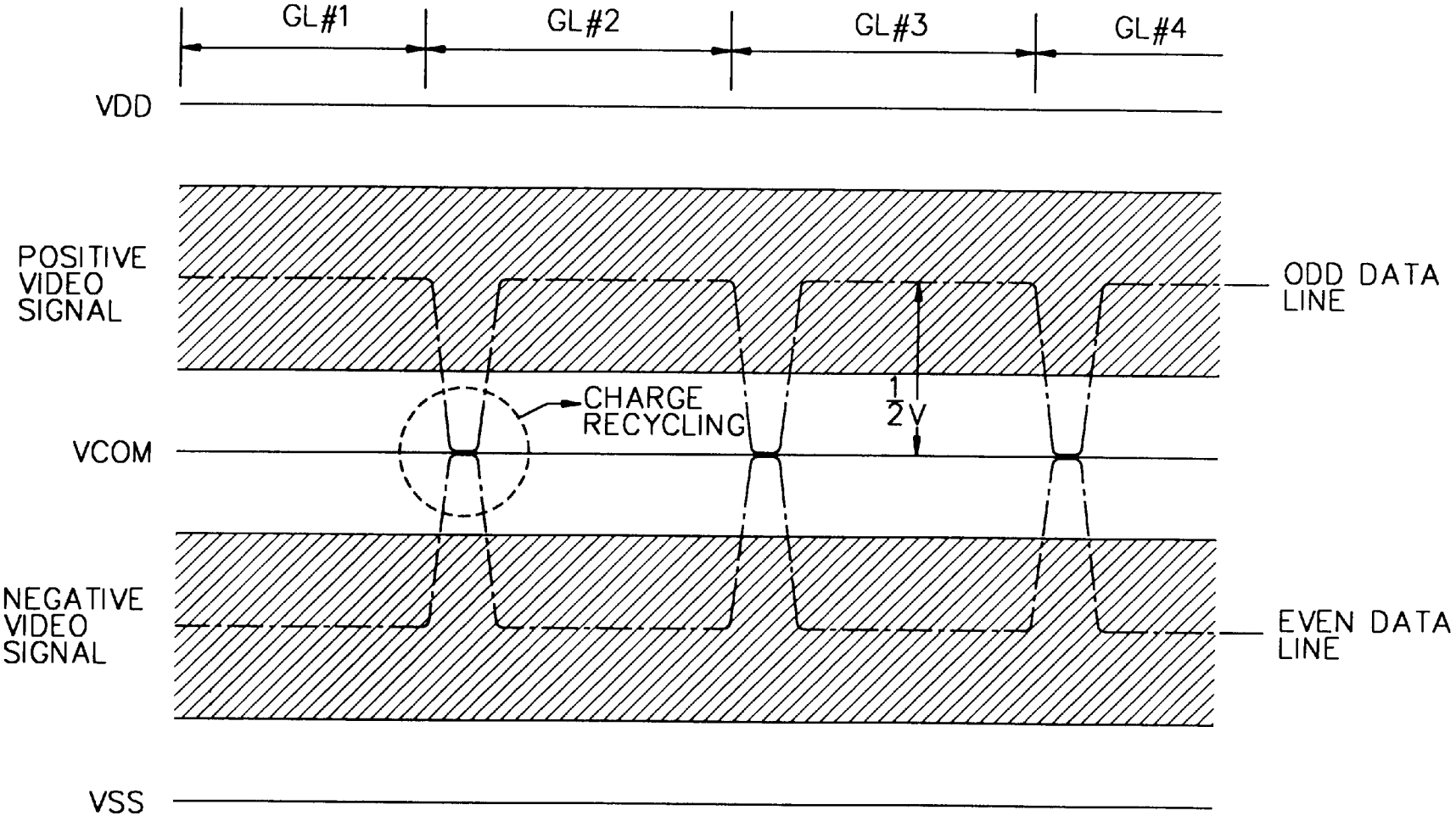
FIG. 6 is a waveform diagram illustrating a driving signal of a TFT-LCD of FIG. 5.

FIG. 6 is a waveform diagram when the electric charge is recycled using the horizontal blank time between the gate lines GL in the dot inversion method. The odd number of the data lines DL and the even number of the data lines DL are connected after the gate line GL is turned on, thus generating a voltage which substantially reaches the level of the median voltage level VCOM without using an externally supplied voltage.

Figure 7:
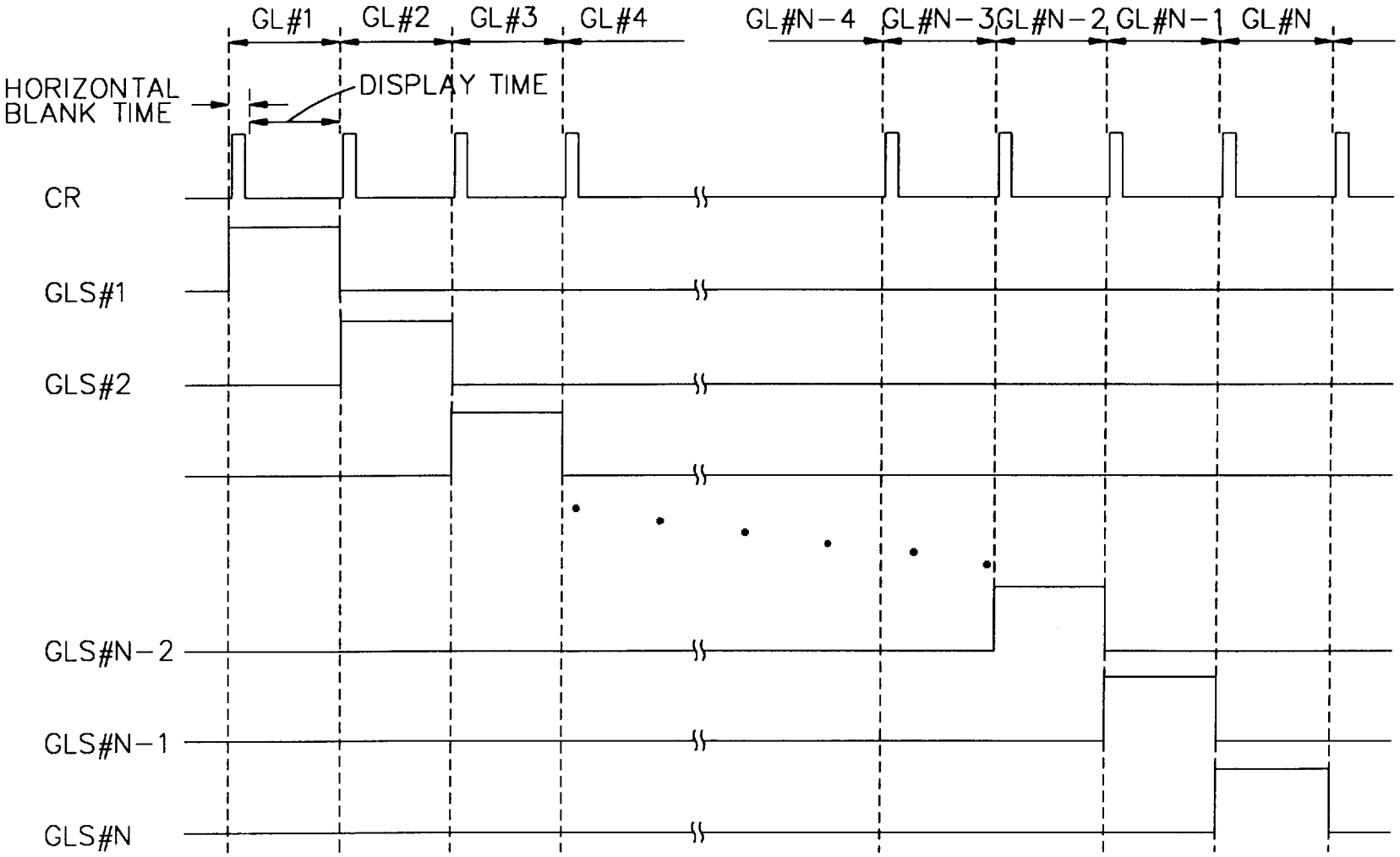
FIG. 7 is a waveform diagram illustrating a dot inversion method of FIG. 5.

As shown in FIG. 7, the gate line selection signals GLS#1 through GLS#n are sequentially inputted from the gate driving unit 30 for a dot inversion method in accordance with one of the preferred embodiments. When the electric charge recycling control signal CR is applied to each of the gate lines GL#1 through GL#n during the horizontal blank time, the transmission gates TG of the recycling unit 40 are turned on. Therefore, the odd number of the data lines DL and the even number of the data lines DL are short-circuited, and as shown in FIG. 6, the voltage between two data lines DL becomes the median voltage level VCOM so that the electric charges are recycled between the adjacent odd and even data lines DL#N and DL#N+1.

When the electric charge recycling control signal CR is not applied thereto, the odd number of the data lines DL and the even number of the data lines DL are separated from each other, and the video signal from the data driving unit 20 is displayed on the LCD panel 10 through the data lines DL.

As shown in FIG. 6, the voltage is varied by about V/2 due to the recycling of the electric charge. Accordingly, the voltage variation due to the external power is reduced to about ½, compared to the conventional TFT-LCD driving circuit in which the variation width of the video signal of the data line DL is V. As a result, the power consumption of the output terminal is reduced to about ½ as follows.

$$P_{NEW}=V_{DD}(C_L\cdot(½)V\cdot F_{reqGL})=½V_{DD}(C_L\cdot V\cdot F_{reqGL})=½P_{CONV}$$

Where, a $P_{NEW}$ is the power consumption of the TFT-LCD of the present inventione, and a $P_{CONV}$ is the power consumption of the TFT-LCD of the conventional art.

Figure 8:
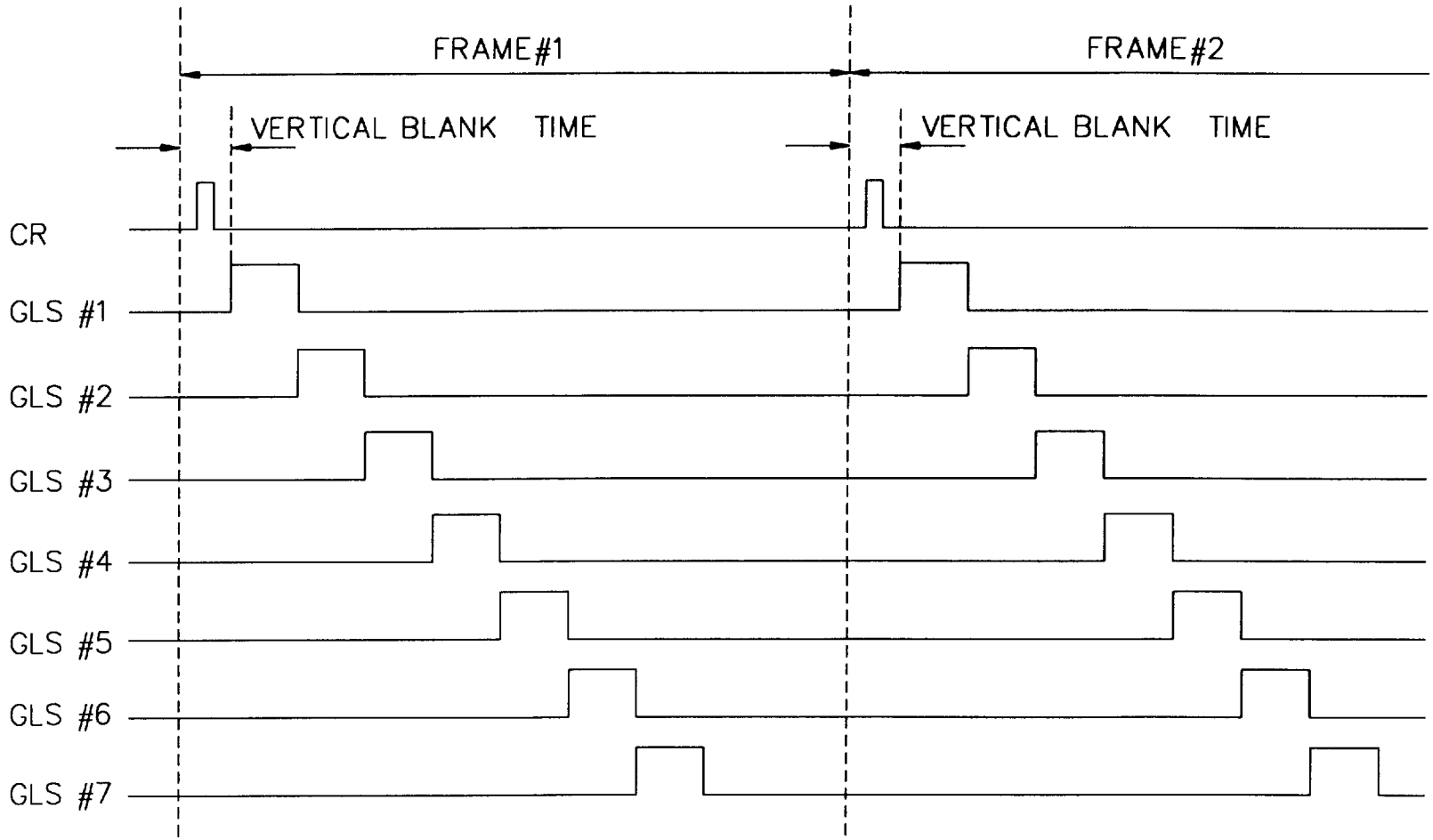
FIG. 8 is a waveform diagram illustrating a column inversion method of FIG. 5.

FIG. 8 illustrates a column inversion method according to another preferred embodiment of the present invention. The electric charges are recycled by applying the electric charge recycling control signal CR during the vertical blank time between the frames. The operation thereof is similar to the dot inversion method. The power consumption of the output terminal is reduced to about ½.

As described above, in the dot inversion method and column inversion method, the electric charge recycling control signal CR is applied to the TFT-LCD driving circuit during the blank time, so that the odd number of the data lines DL and the even number of the data lines DL are connected or short-circuited. The electric charges of the data lines DL are recycled, and the power consumption is reduced by about ½, more or less.

Since the power consumption is decreased, the amount of heat generated is small. When the LCD device is made of the polycrystal silicon thin film transistor (Poly-si TFT), it is possible to increase the performance of the LCD and to reduce the characteristic degradation of the TFT. Furthermore, in the analog driving method, the feedthrough noise is significantly reduced, since it is possible to use a small size analog switch for the data lines.

The foregoing embodiments are merely exemplary and are not to be construed as limiting the present invention. The present teaching can be readily applied to other types of apparatuses and methods. For example, the teachings of the preferred embodiment may be modified for application to frame and line inversion methods. The description of the present invention is intended to be illustrative, and not to limit the scope of the claims. Many alternatives, modifications, and variations will be apparent to those skilled in the art.

What is claimed is:

1. A display device comprising:

a first driving circuit coupled to first signal lines;

a second driving circuit coupled to second signal lines;

a display unit having a plurality of pixels, each pixel coupled to a corresponding first signal line and a corresponding second signal line; and a connector unit coupled to said first driving circuit and the first signal lines, said connector unit connecting corresponding first signal lines to each other for a prescribed period of time, wherein said connector unit connects adjacent odd and even first signal lines said connector unit is a recycling unit which recycles charges on the first signal lines during connection of the adjacent odd and even first signal lines.

2. The display device of claim 1, wherein said display unit is a liquid crystal display panel.

3. The display device of claim 2, wherein each pixel comprises a transistor having first and second electrodes and a control electrode, a first capacitor and a second capacitor, said first and second capacitors being coupled to the second electrode.

4. The display device of claim 3, wherein said first driving circuit is a data driving unit and the first signal lines are data lines, a corresponding data line being coupled to the first electrode of a corresponding transistor of the pixel.

5. The display device of claim 4, wherein said second driving circuit is a gate driving unit and the second signal lines are gate lines, a corresponding gate line being coupled to the control electrode of the corresponding transistor of the pixel.

6. The display device of claim 1, wherein said recycling unit couples adjacent odd and even first signal lines having opposite signal polarity compared to a median voltage level.

7. The display device of claim 6, wherein said recycling unit comprises at least one of a plurality of transmission gates and a plurality of pass transistors, each of said at least one of said plurality of transmission gates and said plurality of pass transistors being connected to adjacent odd and even signal lines and being responsive to a control signal to short circuit adjacent odd and even signal lines.

8. The display device of claim 7, wherein the control signal activates at least one of said plurality of transmission gates and said plurality of pass transistors for the prescribed period of time in between applications of signals on the adjacent odd and even first signal lines.

9. The display device of claim 8, wherein the control signal activates at least one of said plurality of transmission gates and said plurality of pass transistors for the prescribed period of time during horizontal blank times.

10. The display device of claim 8, wherein the control signal activates at least one of said plurality of transmission gates and said plurality of pass transistors for the prescribed period of time during vertical blank times.

11. The display device of claim 1, wherein said connector unit is a recycling unit that short circuits adjacent odd and even first signal lines having opposite signal polarity relative to a median voltage level in response to a control signal of a prescribed level applied for the prescribed period of time.

12. The display device of claim 1, wherein said connector unit connects adjacent odd and even first signal lines for the prescribe period of time in between application of signals on the corresponding first signal lines.

13. The display device of claim 12, wherein the prescribed period of time occurs during horizontal blank times.

14. The display device of claim 12, wherein the prescribed period of time occurs during vertical blank times.

15. A recycling unit for a display device having a plurality of pixels coupled to a plurality of first and second signal lines, comprising:

at least one of a plurality of transmission gates and a plurality of pass transistors, each of said at least one of said plurality of transmission gates and said plurality of pass transistors being connected to corresponding adjacent odd and even first signal lines having opposite signal polarity compared to a median potential level and being responsive to a control signal to short circuit the corresponding adjacent odd and even first signal lines for a prescribed period of time in between application of signals of opposite polarity.

16. The recycling unit of claim 15, wherein the first and second signal lines are data and gate lines, respectively.

17. The recycling unit of claim 15, the corresponding first signal lines are adjacent odd and even first signal lines.

18. The recycling unit of claim 15, wherein the prescribed period of time is one of horizontal blank time and vertical blank time.

19. A method of driving a display device having a plurality of pixels coupled to a plurality of first and second signal lines, the method comprising the steps of:

applying first signals of opposite polarity relative to a median potential level to corresponding first signal lines;

applying a second signal to the plurality of second signal lines in a prescribed sequence; and short circuiting corresponding adjacent odd and even first signal lines having first signals of opposite polarity for a prescribed period of time in between application of first signals such that charges between corresponding adjacent odd and even first signal lines are recycled.

20. The method of claim 19, wherein the first and second signal lines are data and gate lines, respectively.

21. The method of claim 19, the corresponding first signal lines are adjacent odd and even first signal lines.

22. The method of claim 19, wherein the prescribed period of time is one of horizontal blank time and vertical blank time.

* * * * *